US009725893B2

(12) United States Patent
Cain

(10) Patent No.: US 9,725,893 B2
(45) Date of Patent: Aug. 8, 2017

(54) SYSTEM FOR FLUSHING A TOILET

(71) Applicant: Cameron B. Cain, Sunset, UT (US)

(72) Inventor: Cameron B. Cain, Sunset, UT (US)

( * ) Notice: Subject to any disclaimer, the term of this patent is extended or adjusted under 35 U.S.C. 154(b) by 140 days.

(21) Appl. No.: 14/475,391

(22) Filed: Sep. 2, 2014

(65) Prior Publication Data

US 2016/0060855 A1 Mar. 3, 2016

(51) Int. Cl.
*E03D 1/14* (2006.01)
*E03D 1/33* (2006.01)

(52) U.S. Cl.
CPC ..... *E03D 1/33* (2013.01)

(58) Field of Classification Search
CPC ..... E03D 1/142
USPC ..... 4/300–442
See application file for complete search history.

(56) References Cited

U.S. PATENT DOCUMENTS 2,514,040 A * 7/1950 Eksergian ..... B61D 35/007 138/93
5,090,067 A * 2/1992 Cogdill ..... E03D 9/085 4/420.2
7,757,708 B1 * 7/2010 Canfield ..... E03D 1/00 137/389
2015/0013058 A1 * 1/2015 Bucher ..... E03D 9/035 4/378

* cited by examiner

*Primary Examiner* — Lori Baker
(74) *Attorney, Agent, or Firm* — Fehr Law Firm; Thompson E. Fehr

(57) ABSTRACT

A system for flushing a toilet having a pump in fluid communication with a floatable, adjustably buoyant container by being connected with a tube to such floatable, adjustably buoyant container. The floatable, adjustably buoyant container is located inside the water tank of a toilet having a flapper covering the discharge hole in the tank of the toilet and is attached to such flapper. The pump provides a fluid less dense than water to the floatable, adjustably buoyant container and thereby raise the flapper and allow water to proceed through the discharge hole. When the fluid is allowed to leave the floatable, adjustably buoyant container, the flapper is lowered and again seals the discharge hole. An optional embodiment withdraws fluid from a normally inflated resilient container seated within the discharge hole to diminish the size of such normally inflated resilient container and thereby permit water to flow through the discharge hole.

36 Claims, 19 Drawing Sheets

SYSTEM FOR FLUSHING A TOILET

BACKGROUND OF THE INVENTION

Field of the Invention

This invention relates to a fluid-activated system, wherein the fluid is less dense than water and is preferably air, for flushing a traditional toilet.

Description of the Related Art

The inventor was unable to locate a patent for a similar device.

Both U.S. Pat. No. 2,514,040 and German patent application publication no. 4321671 employ an inflatable member to block the effluent discharge line leading from a toilet bowl, but neither utilizes an inflatable resilient container to control the flow of water from the tank in a traditional toilet to the toilet bowl.

And Japanese patent no. 9095992 utilizes a foot switch to supply air to operate the mechanical valve controlling the pressurized water feed line for a toilet having no water tank.

BRIEF SUMMARY OF THE INVENTION

The System for Flushing a Toilet has two principal embodiments. Each is applicable to the type of toilet which has a tank for holding water, a discharge hole for the water contained in the tank, and a flapper which seals the discharge hole when the flapper is seated above and, usually, also in the discharge hole. (As used herein the term "flapper" includes both a traditional flapper for a toilet bowl, the flush valve float of a Mansfield Flush Valve, and any other device utilized temporarily to preclude water from exiting through the discharge hole into the bowl of a toilet.)

The first principal embodiment increases the buoyancy of a container the buoyancy of which can be varied. Preferably, a normally uninflated resilient container (that is either attached to the flapper with a connector or that is an integral portion of the flapper) is inflated with a fluid which is less dense than water, preferably air, in order to use a buoyant force to raise the flapper in the water of the toilet tank and thereby permit the water to exit through the discharge hole into the bowl of the toilet. Optionally, a fluid which is less dense than water, preferably, air is introduced into a rigid container holding water, thereby forcing water from the container through at least one aperture near the bottom of the container and using the resultant increased buoyant force to raise the flapper. The normally uninflated resilient container and the rigid container shall, for the purposes of the present invention, be collectively termed a floatable, adjustably buoyant container.

The second principal embodiment deflates a deflatable resilient container that is seated within the discharge hole of the toilet tank and seals such hole until deflation occurs. Because of this effect, the deflatable resilient container of the second principal embodiment is termed a "stopper." (The stopper may be so constructed, using any technique known to one of ordinary skill in the art, that all of the stopper moves inward upon deflation or so constructed that only a portion of the stopper moves inward upon deflation.)

The fluid, preferably air, is provided or removed with a pump, which can be a mechanical pump (preferably a foot pump) or an electrical pump and is most preferably an electrical pump activated by a motion sensor.

DETAILED DESCRIPTION OF THE INVENTION

Figure 1:
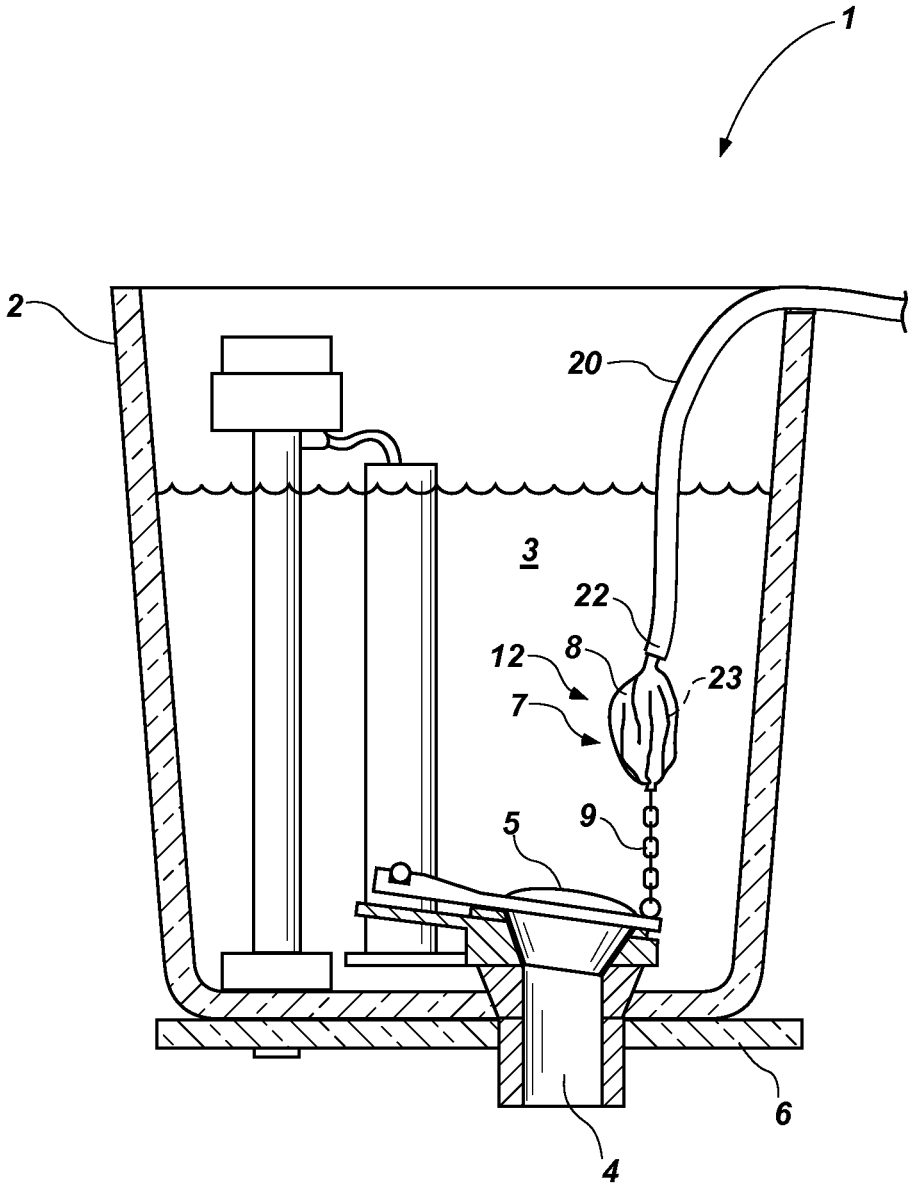
FIG. 1 illustrates a normally uninflated resilient container attached to a flapper with a connector.

As indicated above, the System for Flushing a Toilet has two principal embodiments. Each is applicable to the type of toilet 1 which has a tank 2 for holding water 3, a discharge hole 4 for the water 3 contained in the tank 2, and a flapper 5 which seals the discharge hole 4 when the flapper 5 is seated above and, usually, also in the discharge hole 4. (As used herein the term "flapper" includes both a traditional flapper for a toilet bowl, the flush valve float of a Mansfield Flush Valve, and any other device utilized temporarily to preclude water from exiting through the discharge hole 4 into the bowl 6 of a toilet 1.)

Figure 2:
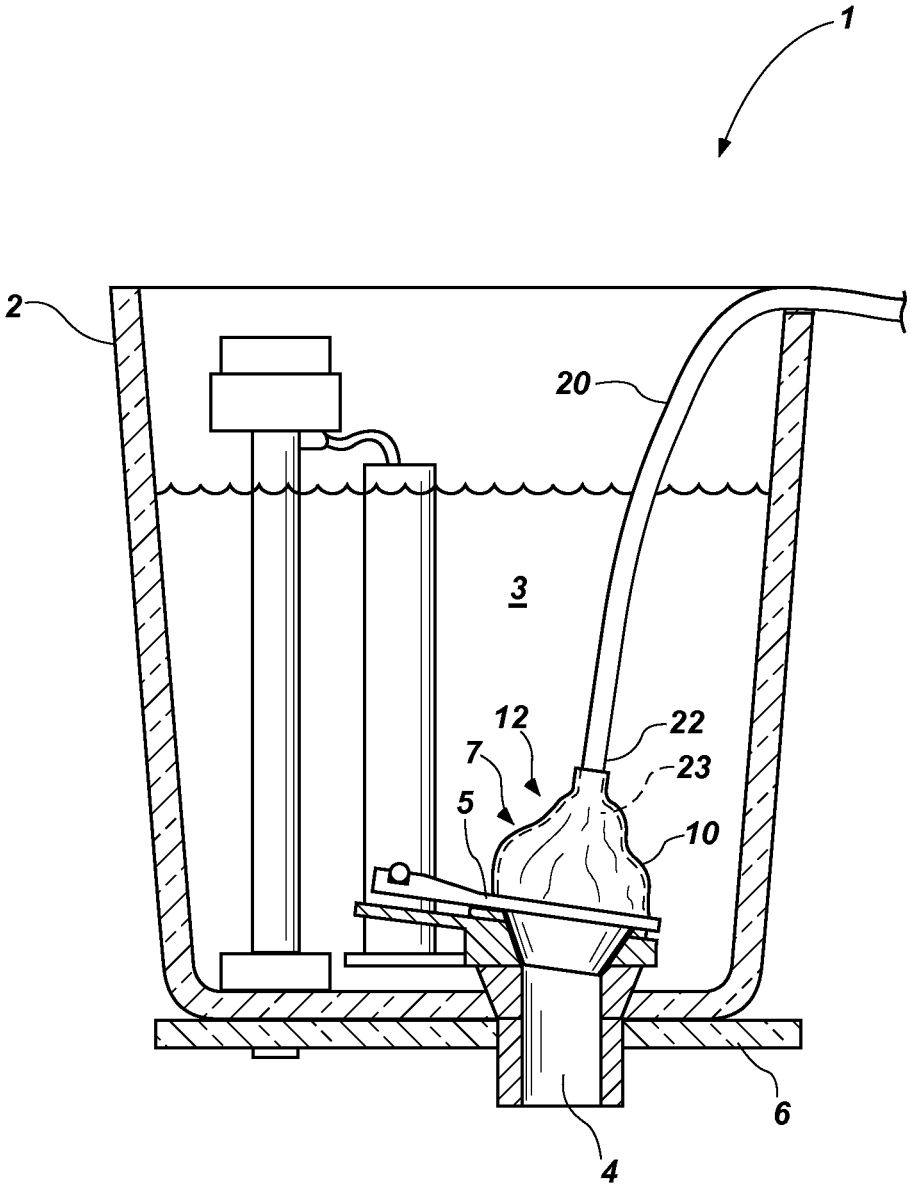
FIG. 2 depicts a normally uninflated resilient container which comprises an integral portion of a flapper.
Figure 3:
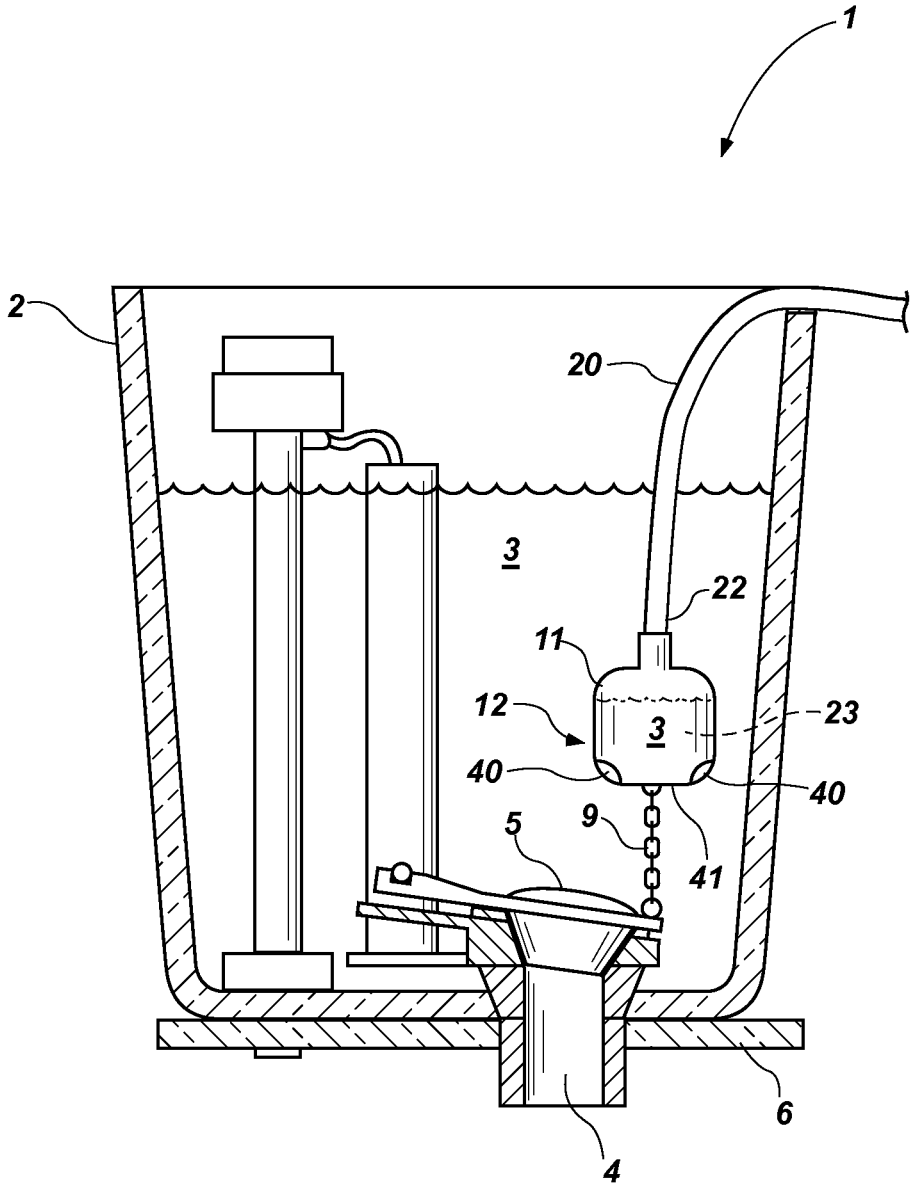
FIG. 3 shows a rigid container holding water attached with a connector to a flapper.
Figure 4:
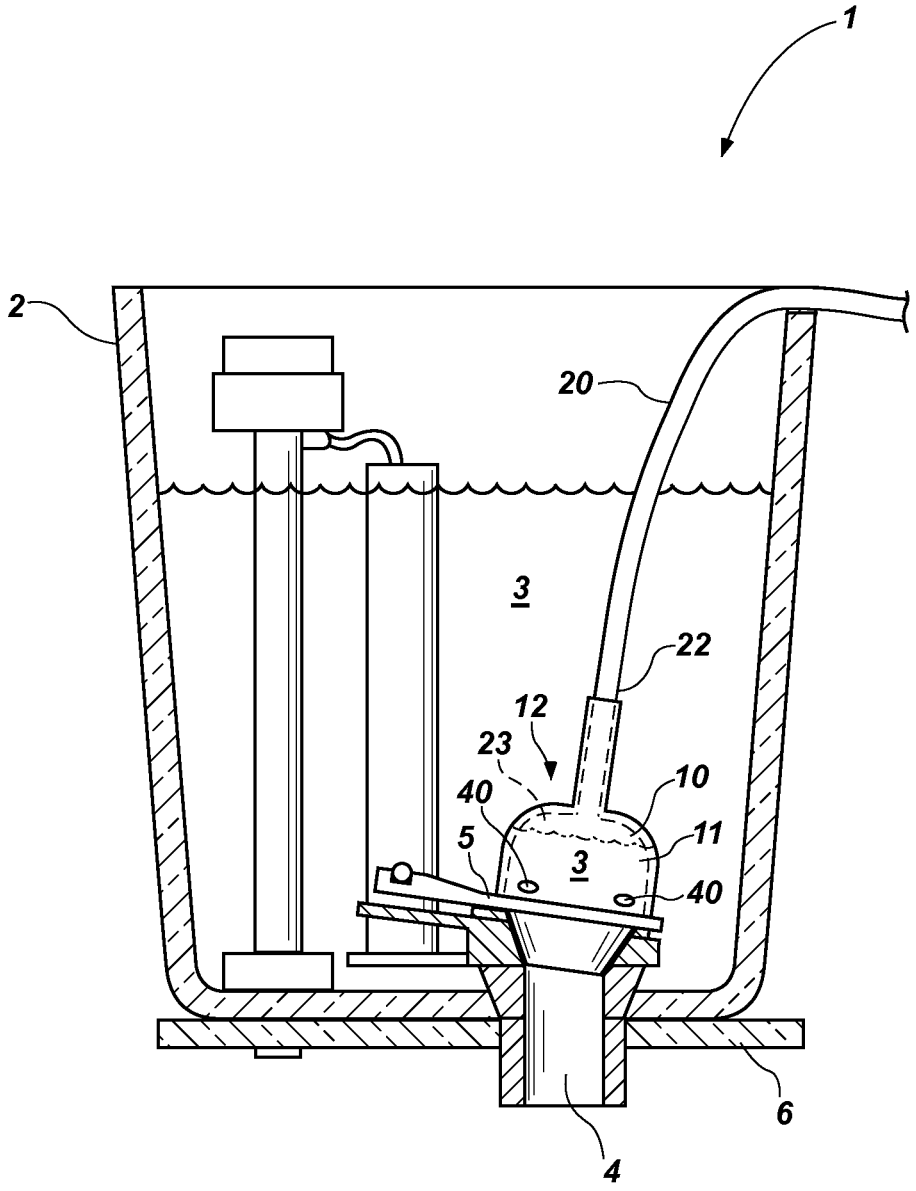
FIG. 4 illustrates a rigid container comprising an integral portion of a flapper.

As further previously noted, the first principal embodiment increases the buoyancy of a container 7 the buoyancy of which can be varied. Preferably, a normally uninflated resilient container 7 (that is either a container 8 attached to the flapper 5 with a connector 9, preferably a flexible connector, such as a chain, as illustrated in FIG. 1, or that is a container 10 comprising an integral portion of the flapper 5, as portrayed in FIG. 2 and which, for the purposes of the present invention, is within the definition of "attached" to the flapper 5) is inflated with a fluid which is less dense than water, preferably air, in order to use a buoyant force to raise the flapper 5 in the water 3 of the toilet tank 2 and thereby permit the water 3 to exit through the discharge hole 4 into the bowl 6 of the toilet 1. Optionally, a fluid which is less dense than water, preferably, air is introduced into a rigid container 11 holding water 1 as depicted in FIG. 3, thereby forcing water 1 from the container 11, through at least one aperture 40 (preferably precisely one aperture 40) near the bottom 41 of the rigid container 11 (preferably at the bottom 41), and using the resultant increased buoyant force to raise the flapper 5 with a connector 9 connecting the rigid container 11 to the flapper 5. The normally uninflated resilient container 7 and the rigid container 11 shall, for the purposes of the present invention, be collectively termed a floatable, adjustably buoyant container 12. And, as with the normally uninflated resilient container 7, the rigid container 11 optionally comprises an integral portion of the flapper 5, as shown in FIG. 4, with the term "attached" in the phrase "attached to the flapper" covering both a rigid container 11 employs a connector 9 and a rigid container 11 which comprises an integral portion of the flapper 5.

Figure 5:
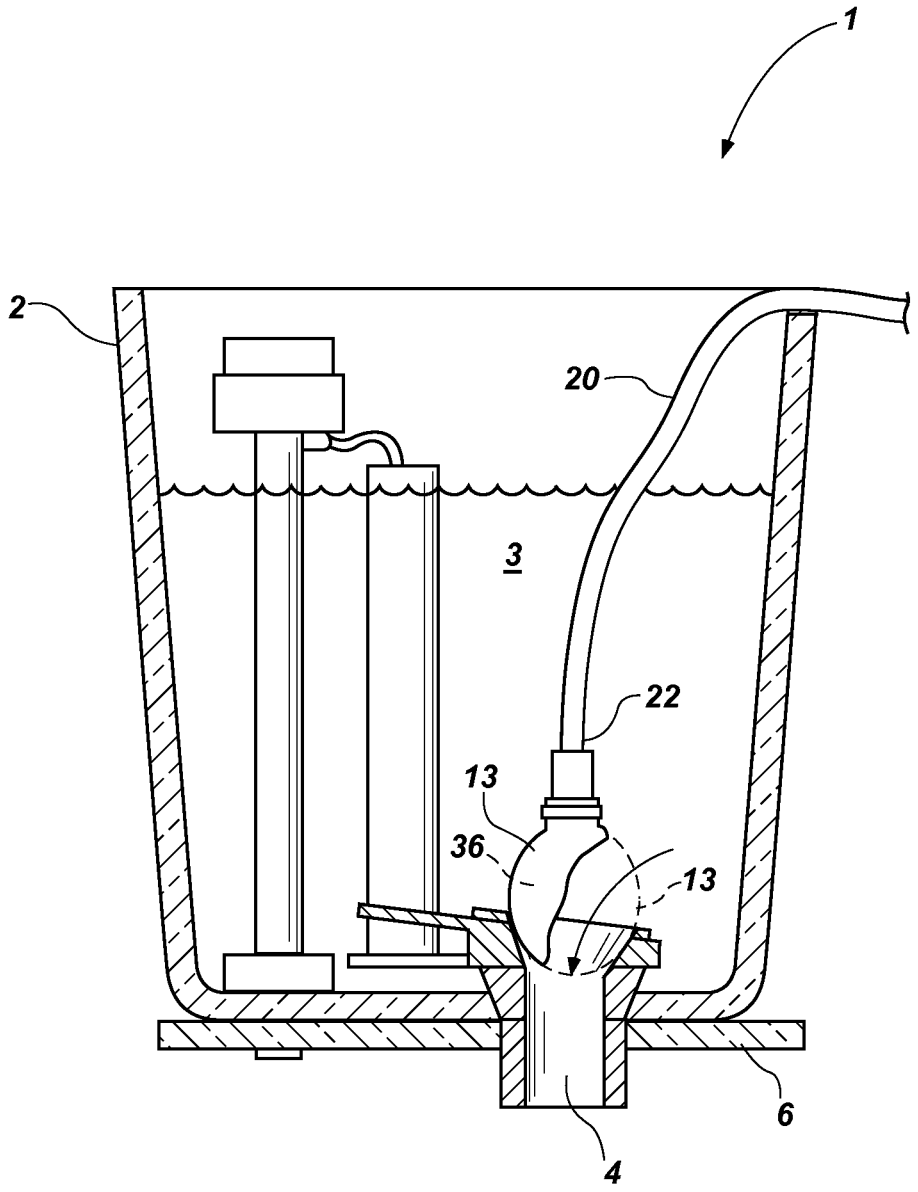
FIG. 5 portrays a deflatable resilient container seated within the discharge hole of a toilet tank.

The second principal embodiment deflates, as described above, a deflatable resilient container 13 that is seated, as shown in FIG. 5, within the discharge hole 4 of the toilet tank 2 and seals such hole 4 until deflation occurs. Because of this effect, the deflatable resilient container 13 of the second principal embodiment is termed a "stopper." (The stopper 13 may, using techniques known by one or ordinary skill in the art, be so constructed that all of the stopper 13 moves inward upon deflation or so constructed that only a portion of the stopper 13 moves inward upon deflation.)

Figure 6:
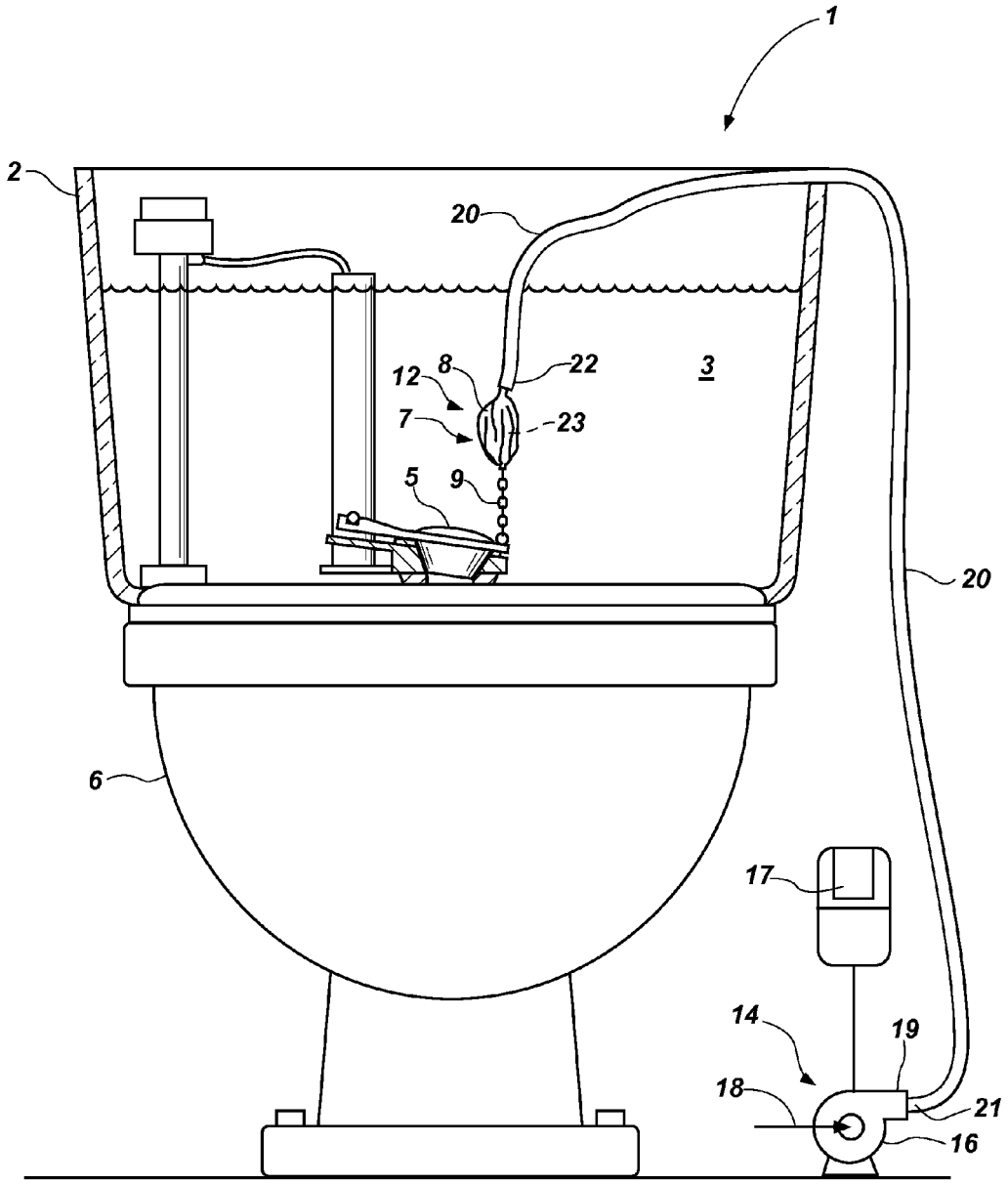
FIG. 6 illustrates an electrical pump activated by a motion sensor.

A fluid which is less dense that water, preferably air, is provided or removed with a pump 14, as mentioned previously, which can be a mechanical pump 15 (preferably a foot pump) or an electrical pump 16 and is most preferably an electrical pump 16 activated by a motion sensor 17, as portrayed in FIG. 6, although a traditional mechanical switch could be utilize in lieu of the motion sensor 17.

Figure 7:
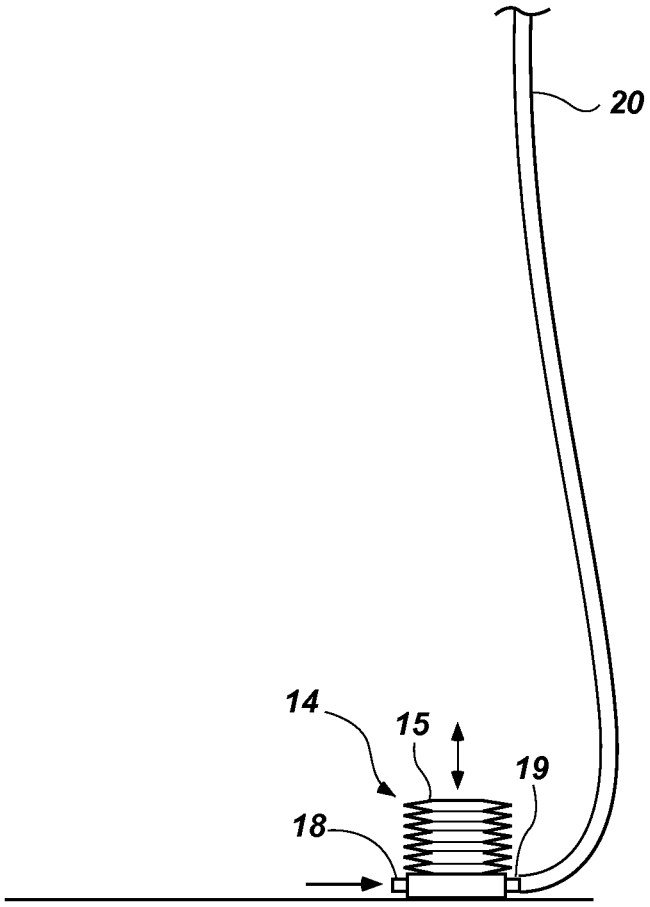
FIG. 7 shows a spring-biased accordion-type mechanical pump.

The mechanical foot pump 15 is preferably a spring-biased accordion-type pump, as shown in FIG. 7, which is biased in the expanded position and depressed by the force exerted by an operator's foot on top of the pump 15.

The pump 14 has an inlet 18 and an outlet 19.

Figure 8:
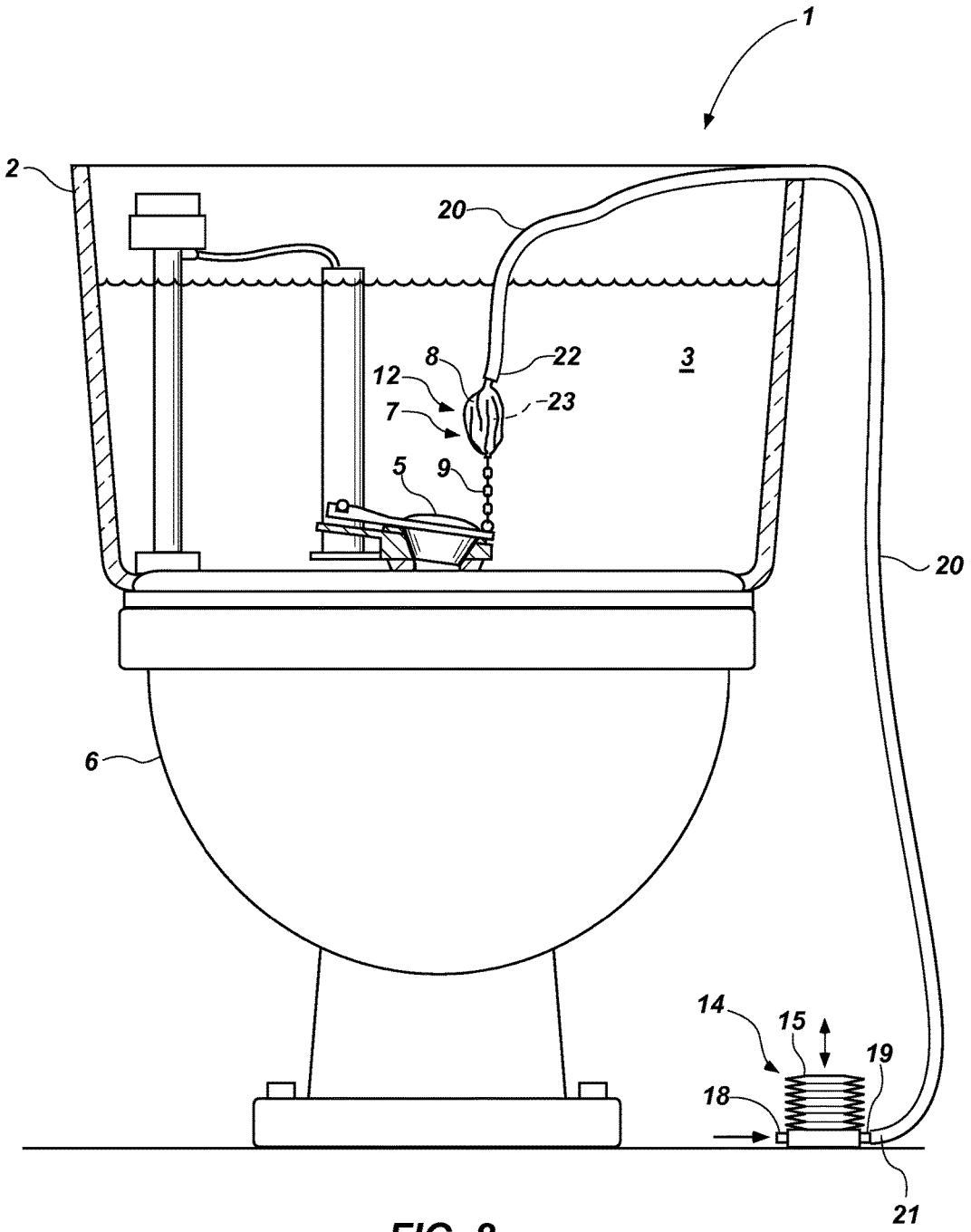
FIG. 8 depicts a flexible tube having a first end in fluid communication with the outlet of a mechanical pump and a second end in fluid communication with a floatable, adjustably buoyant container and also portrays the flapper of the toilet in a closed position.

All embodiments employ a tube 20, preferably a flexible tube 20, having a first end 21 in fluid communication with the outlet 19 of the pump 14 and a second end 22 in fluid communication with the interior 23 of the floatable, adjustably buoyant container 12, as depicted in FIG. 8. The first end 21 of the tube 20 is, in fact, connected to the outlet 19 of the pump 14; and the second end 22 of the tube 20 is connected to the floatable, adjustably buoyant container 12.

Figure 9:
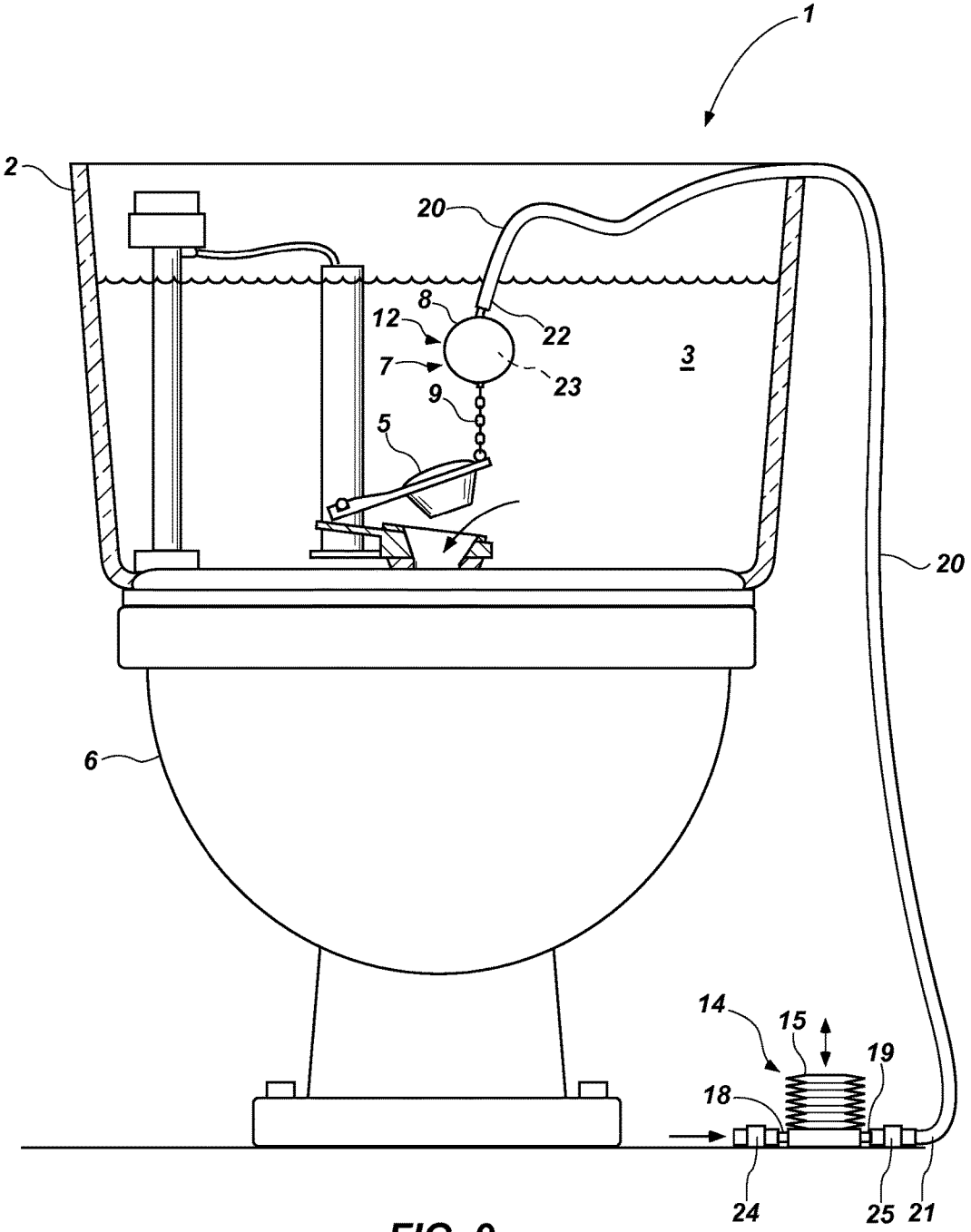
FIG. 9 illustrates a first check valve in fluid communication the inlet of a mechanical pump as well as a second check valve in fluid communication with the outlet of the mechanical pump.

For the first principal embodiment, in which a mechanical pump 15 provides the fluid which is less dense than water, preferably air, to the floatable, adjustably buoyant container 8, 10, 11, there is, as illustrated in FIG. 9, a one-way valve (termed a "check valve") 24, designated the "first check valve" 24, in fluid communication with the inlet 18 which permits the fluid which is less dense than water, preferably air, to flow into the mechanical pump 15. Similarly, there, as also depicted in FIG. 9, is a one-way valve (termed a "check valve") 25, designated the "second check valve" 25, in fluid communication with the outlet 19 which permits the fluid which is less dense than water, preferably air, to flow from the mechanical pump 15.

When a mechanical pump 15 is activated by an operator pressing the operator's foot on the pump 15, or when an electrical pump 16 is activated, fluid which is less dense than water, preferably air, flows through the outlet 19 from the pump 15, 16 to the floatable, adjustably buoyant container 12; and the buoyancy of the floatable, adjustably buoyant container 12 is increased as explained above causing the flapper 5 to rise and thereby allowing water to leave the tank 2 through the discharge hole 4.

Figure 10:
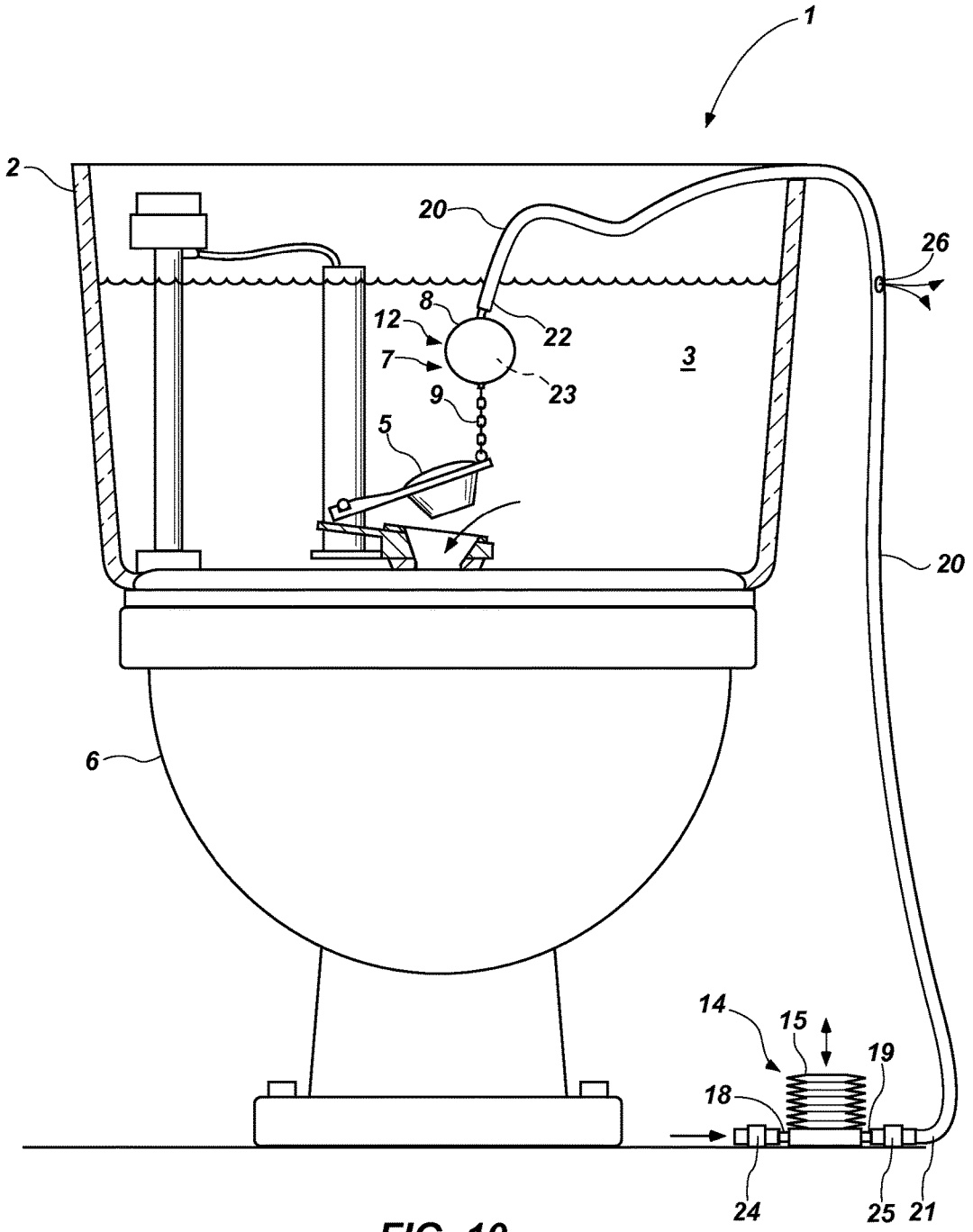
FIG. 10 shows an aperture in the tube between a pump and a floatable, adjustably buoyant container while also illustrating the flapper of the toilet in an open position.

The tube 20, however, contains at least one aperture 26, as seen in FIG. 10. The additional fluid which is less dense than water, preferably air, that has been introduced into the floatable, adjustably buoyant container 12 will, therefore, eventually dissipate through the aperture 26 allowing the flapper 5 again temporarily to seal the discharge hole 4. (The aperture 26 in the tube 20, shown in FIG. 10, comprise, therefore, a first embodiment of the means for controlling the time the flapper does not seal the discharge hole of claim 1 and the claims dependent thereon.) The time for the additional fluid which is less dense than water, preferably air, to dissipate and, consequently, the duration of the flush will be controlled by the size of the aperture 26. With an electrical pump 16, though, the aperture 26 in the tube 20 is necessary only if the electrical pump 16 is not equipped with technology known to one of ordinary skill in the art, to reverse the pump 16. With such technology the duration of the flush can be controlled either by a user utilizing any switch known to one of ordinary skill in the art to change the direction of the flow of fluid which is less dense than water, preferably air, through the pump 16 or by employing timing circuitry which is known to one of ordinary skill in the art automatically to reverse the flow of fluid which is less dense than water, preferably through the pump 16. (The electrical pump 16 equipped with technology known to one of ordinary skill in the art to reverse the pump 16 and a switch known to one of ordinary skill in the art to change the direction of the flow of fluid which is less dense than water, preferably air, through the pump 16, therefore, comprise a second embodiment of the means for controlling the time the flapper does not seal the discharge hole of claim 1 and the claims dependent thereon. And electrical pump 16 equipped with technology known to one of ordinary skill in the art, to reverse the pump 16 and timing circuitry which is known to one of ordinary skill in the art automatically to reverse the flow of fluid which is less dense than water, preferably through the pump 16 comprise a third embodiment of the means for controlling the time the flapper does not seal the discharge hole of claim 1 and the claims dependent thereon.)

Figure 11:
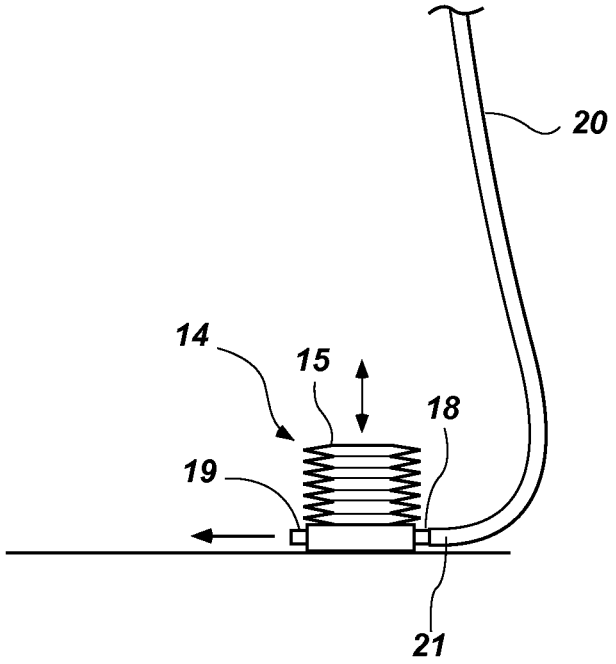
FIG. 11 depicts a pump for removing fluid, preferably air, from a deflatable resilient container.
Figure 12:
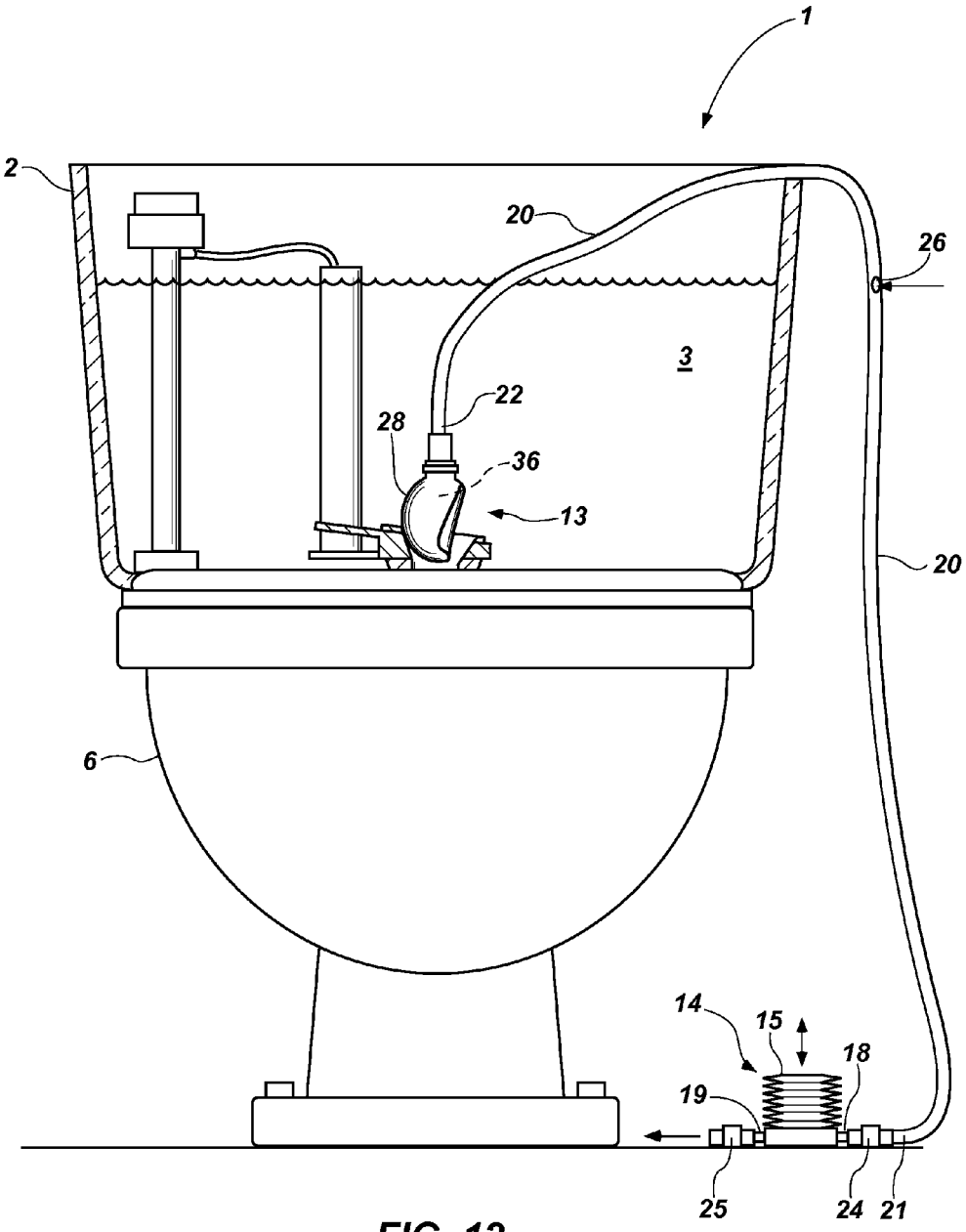
FIG. 12 portrays a tube having its first end connected to the inlet of a mechanical pump and its second end connected to a deflatable resilient container.

For the second principal embodiment, in which the pump 14 removes fluid which is less dense than water, preferably air, from a deflatable resilient container 11, which is illustrated in FIG. 11, the pump 14 is the same as for the first principal embodiment except that for the mechanical pump 15 the flow of fluid which is less dense than water, preferably gas air, is reversed, with the fluid which is less dense than water, preferably air, flowing from the deflatable resilient container 11 to the inlet 18 of the mechanical pump 15 and exiting the mechanical pump 15 to the atmosphere, when air is the fluid, through the outlet 19 of the mechanical pump 15. In this embodiment the tube 20 is connected to and in fluid communication with the interior 36 of the deflatable resilient container 11 as well as the inlet 18 of the mechanical pump 15 and, therefore, has, as illustrated in FIG. 12, its first end 21 attached to the inlet 18 of the mechanical pump 15 and its second end 22 connected to the deflatable resilient container 11. Moreover, when the pump 14 is a mechanical pump 15, the tube 20 contains the aperture 26 to allow fluid which is less dense than water, preferably air, to reinflate the deflatable resilient container 11 and thereby reseal the discharge hole. (The aperture 26 in the tube 20, shown in FIG. 10, comprise, therefore, a first embodiment of the means for controlling the time the deflatable resilient container is sufficiently deflated not to seal the discharge hole of claim 28 and the claims dependent thereon.) The electrical pump 16 is, utilizing any technology known to one of ordinary skill in the art, simply operated in reverse to the direction of operation of the electrical pump 16 in the first principal embodiment. (Of course, electric circuitry that is well known in the art could be employed to direct that the fluid which is less dense than water, preferably air, be withdrawn and that fluid which is less dense than water, preferably air, be provided by one press of the switch, with such circuitry using a time or times between withdrawal and provision of the gas that is set by the manufacturer or the operator to achieve proper flushing of the toilet (Such reversible electrical pump 16 electrical circuitry using a time or times between withdrawal and provision of the gas that is set by the manufacturer or the operator to achieve proper flushing of the toilet, therefore, comprises a second embodiment of the means for controlling the time the deflatable resilient container is sufficiently deflated not to seal the discharge hole of claim 28 and the claims dependent thereon.); also, as with the first principal embodiment an option is for the user, utilizing any switch known to one of ordinary skill in the art, to change the direction of the flow of fluid which is less dense than water, preferably air, through the pump 16 at the desired time to deflate and inflate the deflatable resilient container 11 (The reversible electrical pump 16 and a switch known to one of ordinary skill in the art to change the direction of the flow of fluid which is less dense than water, preferably air, through the pump 16, therefore, comprise a third embodiment of the means for controlling the time the deflatable resilient container is sufficiently deflated not to seal the discharge hole of claim 28 and the claims dependent thereon.).)

Figure 13:
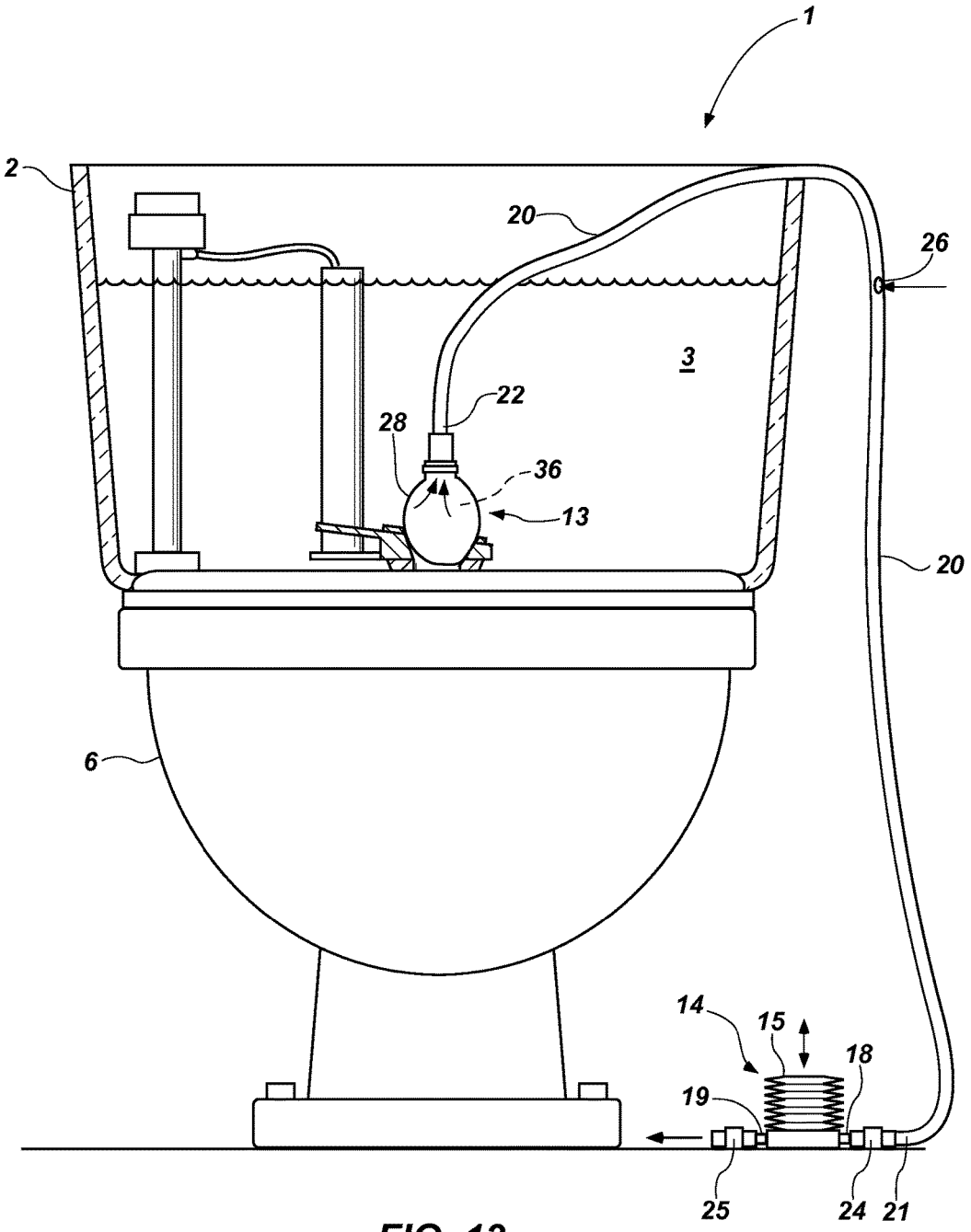
FIG. 13 shows a normally deflatable container seated in the discharge aperture of a toilet.
Figure 14:
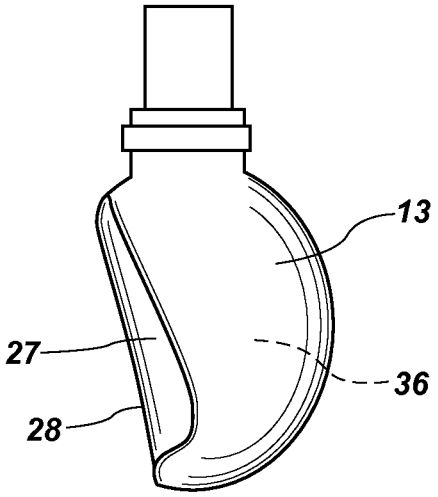
FIG. 14 depicts a deflatable resilient container having a dimple to assist inward movement of the wall of the deflatable resilient container during deflation.

The deflatable resilient container 11 is shaped so as to permit seating of the container in the discharge aperture 4 of the toilet 1 as depicted in FIG. 13. Optionally, the container 11 contains, as portrayed in FIG. 14, a dimple 27 to assist inward movement of the wall 28 of the deflatable resilient container 11 during deflation.

Consumers sometimes prefer to have a choice between two different lengths of flushing time. This can be achieved in multiple ways with the present invention.

Figure 15:
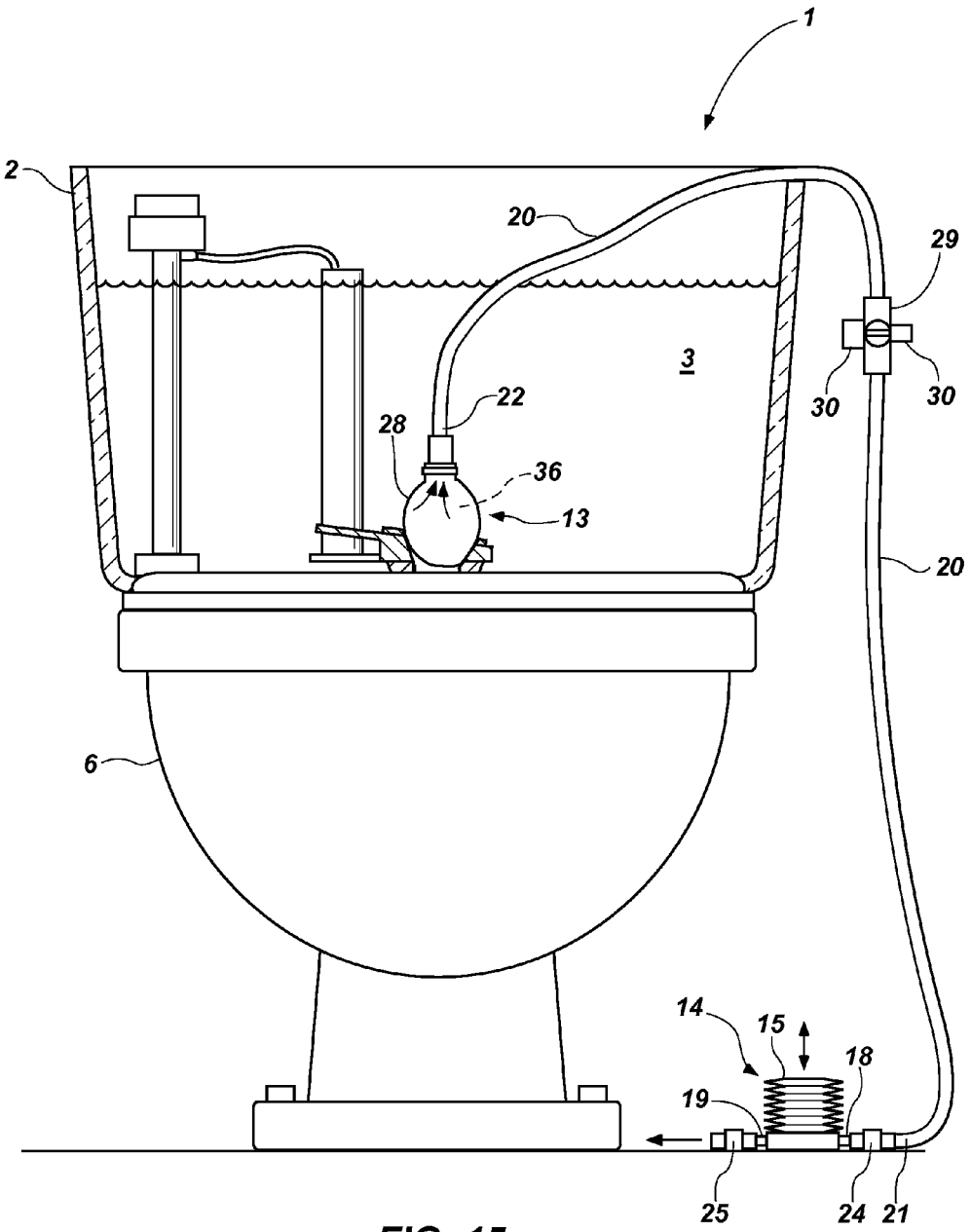
FIG. 15 portrays in the tube a valve which can be switched between two differently sized exhaust ports.

With any embodiment or pump 14, two different flush times can be achieved by replacing the at least one aperture 26 in the tube 20 with a valve 29 which can be switched between two differently sized exhaust ports 30, as illustrated in FIG. 15. (The valve 29 in the tube 20, shown in FIG. 15, therefore, comprise a fourth embodiment of the means for controlling the time the flapper does not seal the discharge hole of claim 1 and the claims dependent thereon. Such valve 29 in the tube 20, shown in FIG. 15, therefore, comprise a fourth embodiment of the means for controlling the time the deflatable resilient container is sufficiently deflated not to seal the discharge hole of claim 28 and the claims dependent thereon.)

Figure 16:
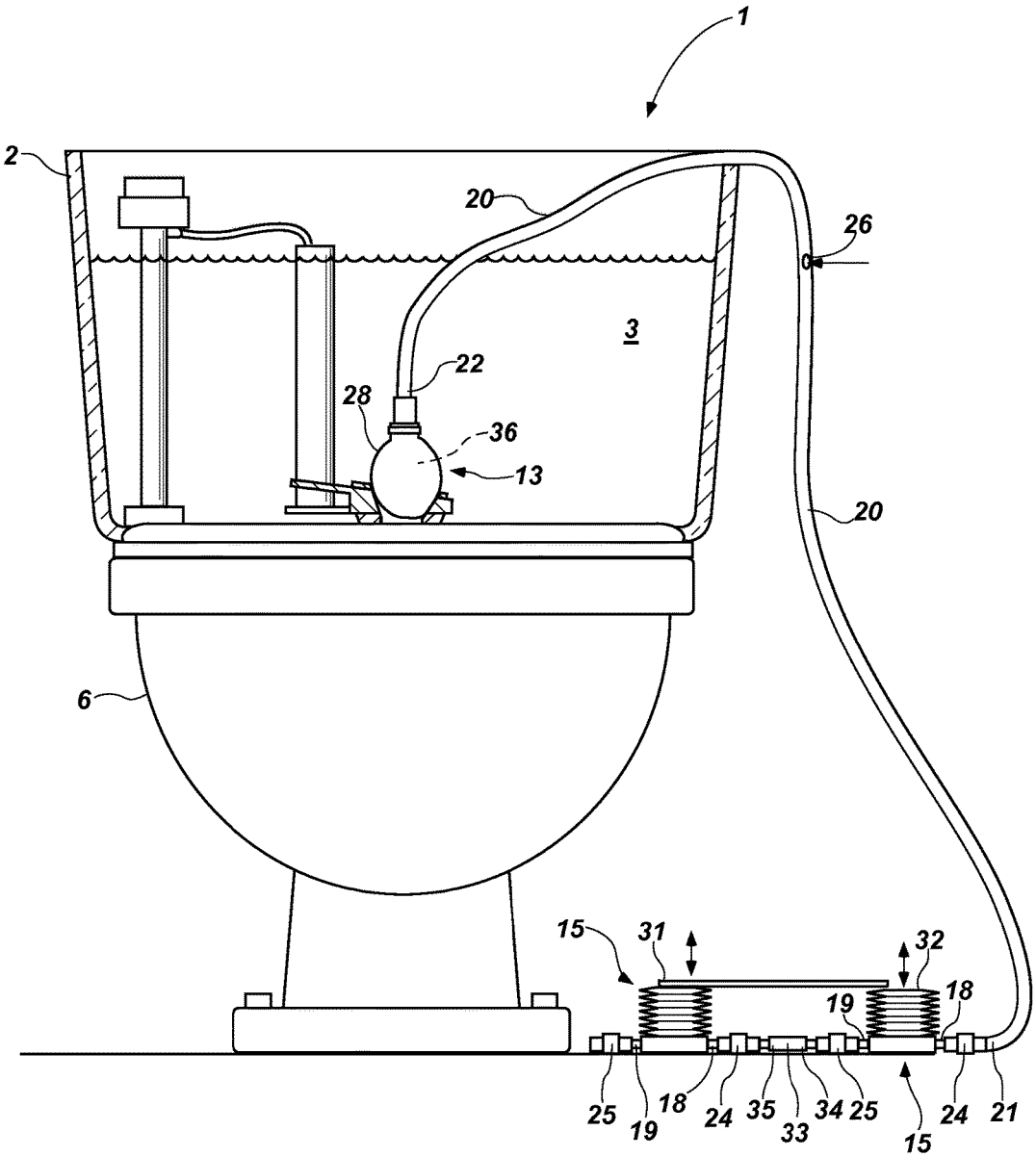
FIG. 16 illustrates two mechanical pumps connected in series.

Optionally, two mechanical pumps 15 could be connected in series, as shown in FIG. 16, with the joint activation of both being used to extend the flush time. For even more convenience, the top 31 of one of the mechanical pumps 15 could extend over the top 32 of the other mechanical pump 15 so that a user could simply depress the top 32 of the mechanical pump 15 that did not extend over the other mechanical pump 15 in order to have a shorter flush time and depress the top 31 of the mechanical pump that extends over the other mechanical pump 15 to have a longer flush time. For the first principal embodiment a second tube 33 has a first end 34 attached to and in fluid communication with the outlet 19 of the second mechanical pump 15 and a second end 35 attached to and in fluid communication with the inlet 18 of the first mechanical pump 15. For the second principal embodiment the second tube 33 has a first end 34 attached to and in fluid communication with the inlet 18 of the second mechanical pump 15 and a second end 35 attached to and in fluid communication with the outlet 19 of the first mechanical pump 15. And, as does the first mechanical pump 15, the second mechanical pump 15 has a one-way valve (termed a "check valve") 24, designated the "first check valve" 24, in fluid communication with the inlet 18 which permits the fluid which is less dense than water, preferably air, to flow into the second mechanical pump 15 and also has a one-way valve (termed a "check valve") 24, designated the "second check valve" 24, in fluid communication with the outlet 19 which permits the fluid which is less dense than water, preferably air, to flow from the second mechanical pump 15.

Figure 17:
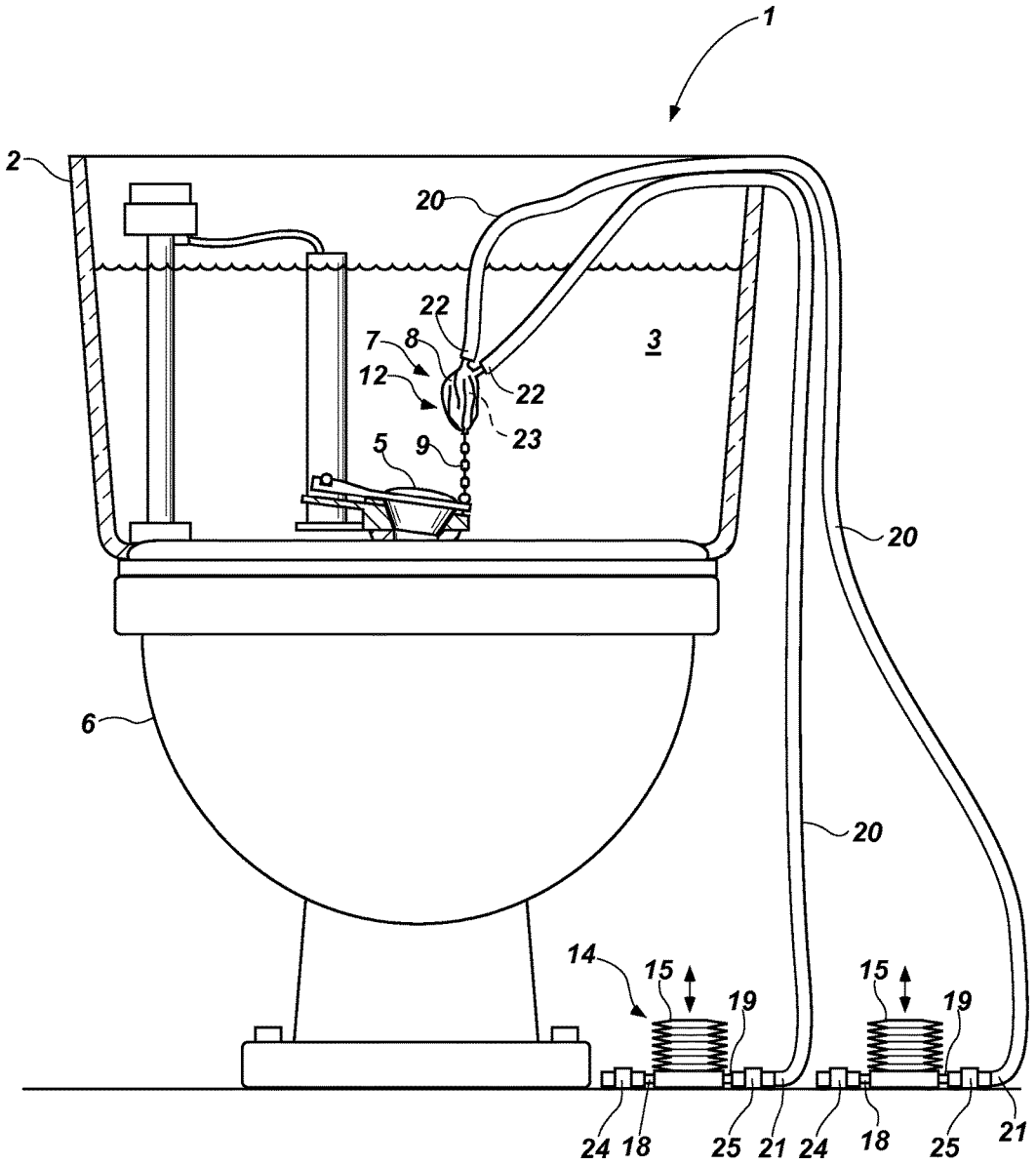
FIG. 17 shows two pumps operated in parallel where each pump has a completely independent tube connected to, and in fluid communication with, the floatable, adjustably buoyant container or the normally resilient container.
Figure 18:
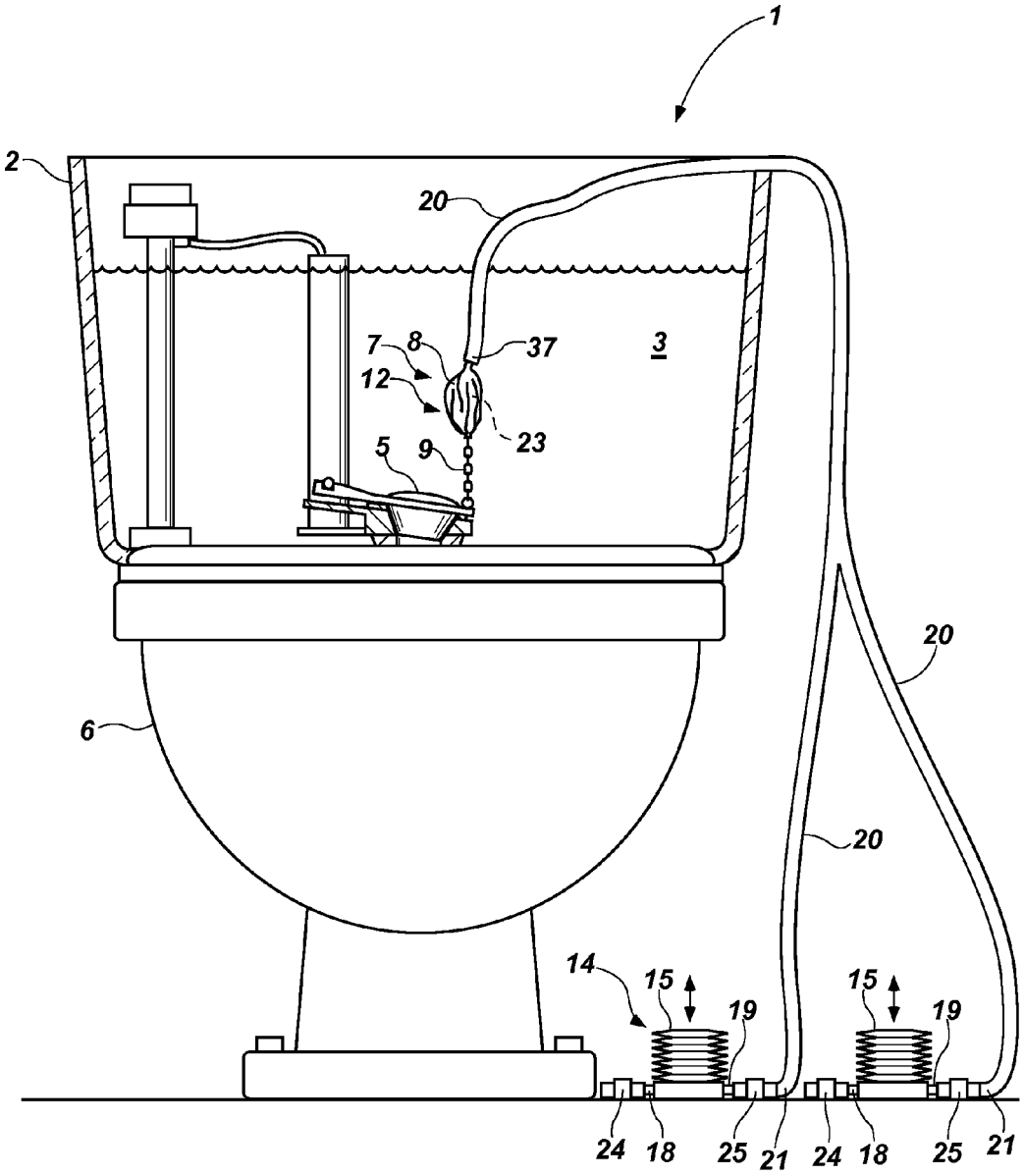
FIG. 18 portrays two pumps operated in parallel where the tubes from the two pumps join together before being connected to the floatable, adjustably buoyant container or the normally resilient container.

Any two pumps 14, mechanical 15 or electrical 16, could be operated in parallel, as seen in FIG. 17, to obtain a longer flush time. When two pumps 14 are operating in parallel, each pump 14 has, as illustrated in FIG. 17 its outlet 19 attached to and in fluid communication with a first end 21 of its own associated tube 20. The second end 22 of each associated tube 20 can, as illustrated in FIG. 17, be independently connected to and in fluid communication with the interior 23 of the floatable, adjustably buoyant container 12, in the case of the first principal embodiment, or the interior 36 of the deflatable resilient container 11, in the case of the second principal embodiment. Alternatively, the two tubes 20 can join together before being connected to the floatable, adjustably buoyant container 12 or the deflatable resilient container 11 and, therefore, have, as portrayed in FIG. 18, a common second end 37 connected to and in fluid communication with the interior 23 of the floatable, adjustably buoyant container 12, in the case of the first principal embodiment, or the interior 36 of the deflatable resilient container 11, in the case of the second principal embodiment.

Figure 19:
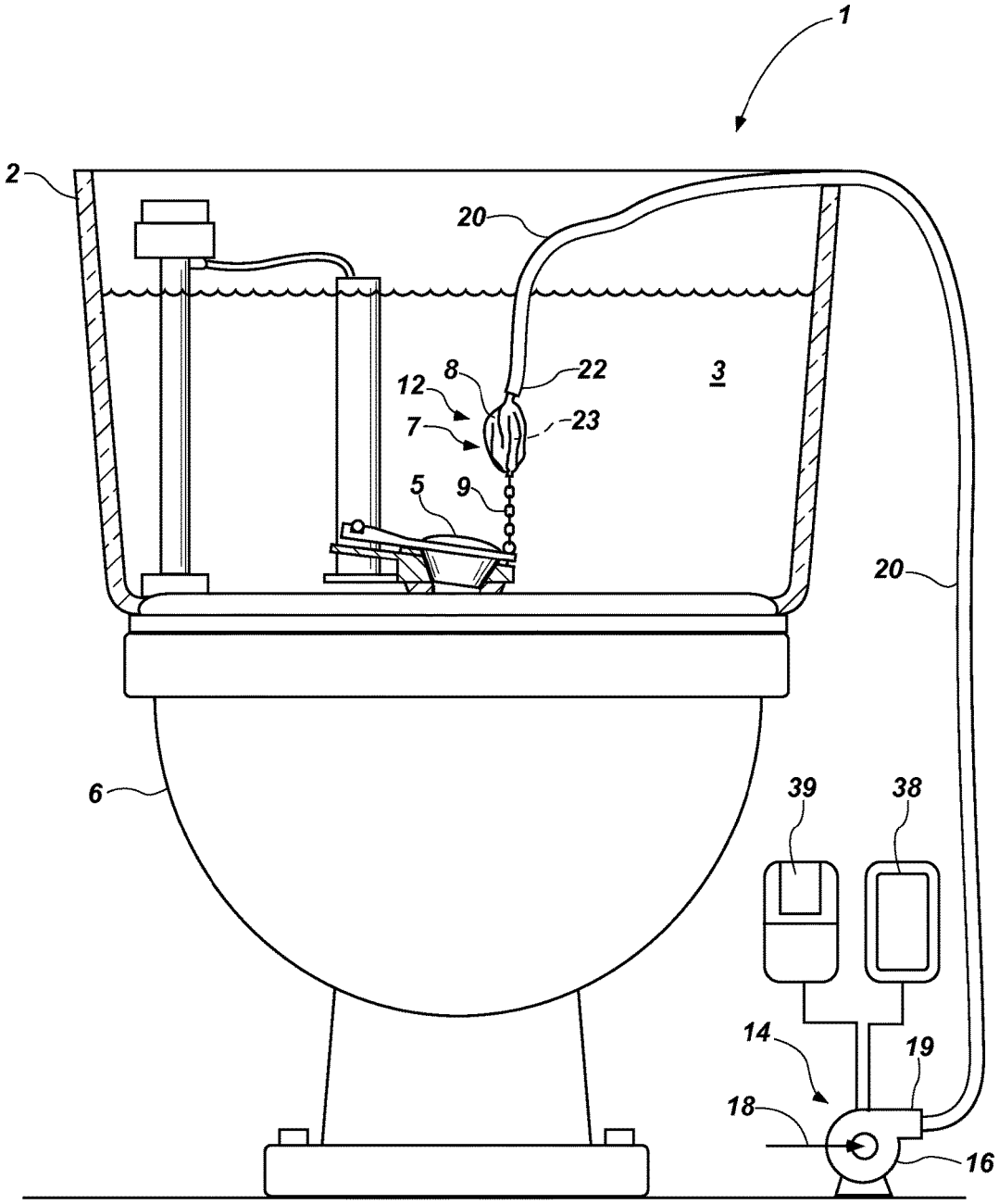
FIG. 19 depicts a single electrical pump with two different motion sensors.

And, as an option to having a valve 29, a single electrical pump 16 could have a user operate the switch known in the art at appropriate times to achieve the desired flush time; or such single electrical pump 16 could have an adjustable timer known in the art or two separate timers known in the art with, as shown in FIG. 19, a first motion sensor 38 used, employing any technology known to one of ordinary skill in the art, to select a shorter flush time on the adjustable timer or to select the timer having the shorter period of operation when there are two timers and a second motion sensor 39 being utilized to select a longer flush time on the adjustable timer or to select the timer having the longer period of operation when there are two timers.

As a further option, using any technology known in the art a liquid which produces a fragrance could be inserted in the tube 20 or at the outlet 19 of the pump.

Finally, it should be noted that as used herein the term "preferable" or "preferably" means a specified element or technique is more acceptable than another but not that such specified element or technique is a necessity.

I claim:

1. A system for flushing a toilet that has a flapper covering the discharge hole in the tank of the toilet, which comprises:

a floatable, adjustably buoyant container having an interior and being attached to the flapper;

a pump having an inlet and an outlet;

a tube having a first end connected to and in fluid communication with the outlet of said pump and having a second end connected to and in fluid communication with the interior of said floatable, adjustably buoyant container; and a means for controlling the time the flapper does not seal the discharge hole.

2. The system for flushing a toilet as recited in claim 1, wherein:

said means for controlling the time the flapper does not seal the discharge hole comprises an aperture in said tube.

3. The system for flushing a toilet as recited in claim 1, wherein:

said means for controlling the time the flapper does not seal the discharge hole comprises a valve in said tube, said valve being switchable between two differently sized exhaust ports associated with said valve.

4. The system for flushing a toilet as recited in claim 1, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and further comprising:

a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump; and a second tube having a first end attached to and in fluid communication the outlet of said second mechanical pump and a second end attached to and in fluid communication with the inlet of said first mechanical pump.

5. The system for flushing a toilet as recited in claim 1, further comprising:

a second pump having an inlet and an outlet; and a second tube having a first end connected to and in fluid communication with the outlet of said second pump and having a second end connected to and in fluid communication with the interior of said floatable, adjustably buoyant container.

6. The system for flushing a toilet as recited in claim 5, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and said second pump is a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump.

7. The system for flushing a toilet as recited in claim 5, wherein:

said first pump is an electrical pump; and said second pump is an electrical pump.

8. The system for flushing a toilet as recited in claim 1, wherein:

said pump is an electrical pump having adjustable timing circuitry to reverse the fluid flow through said pump; and further comprising:

a first motion sensor in communication with said pump to select a shorter flush time on the adjustable timing circuitry; and a second motion sensor in communication with said pump to select a longer flush time on the adjustable timing circuitry.

9. The system for flushing a toilet as recited in claim 1, wherein:

said pump is an electrical pump having a first timer with a first flushing time and a second time with a second flushing time; and further comprising:

a first motion sensor in communication with said pump to operate the first timer; and a second motion sensor in communication with said pump to operate the second timer.

10. The system for flushing a toilet as recited in claim 1, wherein:

the floatable, adjustably buoyant container is a normally uninflated resilient container.

11. The system for flushing a toilet as recited in claim 10, wherein:

said means for controlling the time the flapper does not seal the discharge hole comprises an aperture in said tube.

12. The system for flushing a toilet as recited in claim 10, wherein:

said means for controlling the time the flapper does not seal the discharge hole comprises a valve in said tube, said valve being switchable between two differently sized exhaust ports associated with said valve.

13. The system for flushing a toilet as recited in claim 10, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and further comprising:

a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump; and a second tube having a first end attached to and in fluid communication the outlet of said second mechanical pump and a second end attached to and in fluid communication with the inlet of said first mechanical pump.

14. The system for flushing a toilet as recited in claim 10, further comprising:

a second pump having an inlet and an outlet; and a second tube having a first end connected to and in fluid communication with the outlet of said second pump and having a second end connected to and in fluid communication with the interior of said normally uninflated resilient container.

15. The system for flushing a toilet as recited in claim 14, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and said second pump is a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump.

16. The system for flushing a toilet as recited in claim 14, wherein:

said first pump is an electrical pump; and said second pump is an electrical pump.

17. The system for flushing a toilet as recited in claim 10, wherein:

said pump is an electrical pump having adjustable timing circuitry to reverse the fluid flow through said pump; and further comprising:

a first motion sensor in communication with said pump to select a shorter flush time on the adjustable timing circuitry; and a second motion sensor in communication with said pump to select a longer flush time on the adjustable timing circuitry.

18. The system for flushing a toilet as recited in claim 10, wherein:

said pump is an electrical pump having a first timer with a first flushing time and a second timer with a second flushing time; and further comprising:

a first motion sensor in communication with said pump to operate the first timer; and a second motion sensor in communication with said pump to operate the second timer.

19. The system for flushing a toilet as recited in claim 1, wherein:

the floatable, adjustably buoyant container is a rigid container having a bottom and also having at least one aperture near such bottom.

20. The system for flushing a toilet as recited in claim 19, wherein:

said means for controlling the time the flapper does not seal the discharge hole comprises an aperture in said tube.

21. The system for flushing a toilet as recited in claim 19, wherein:

said means for controlling the time the flapper does not seal the discharge hole comprises a valve in said tube, said valve being switchable between two differently sized exhaust ports associated with said valve.

22. The system for flushing a toilet as recited in claim 19, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and further comprising:

a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump; and a second tube having a first end attached to and in fluid communication the outlet of said second mechanical pump and a second end attached to and in fluid communication with the inlet of said first mechanical pump.

23. The system for flushing a toilet as recited in claim 19, further comprising:

a second pump having an inlet and an outlet; and a second tube having a first end connected to and in fluid communication with the outlet of said second pump and having a second end connected to and in fluid communication with the interior of said rigid container.

24. The system for flushing a toilet as recited in claim 23, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and said second pump is a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump.

25. The system for flushing a toilet as recited in claim 23, wherein:

said first pump is an electrical pump; and said second pump is an electrical pump.

26. The system for flushing a toilet as recited in claim 19, wherein:

said pump is an electrical pump having adjustable timing circuitry to reverse the fluid flow through said pump; and further comprising:

a first motion sensor in communication with said pump to select a shorter flush time on the adjustable timing circuitry; and a second motion sensor in communication with said pump to select a longer flush time on the adjustable timing circuitry.

27. The system for flushing a toilet as recited in claim 19, wherein:

said pump is an electrical pump having a first timer with a first flushing time and a second time with a second flushing time; and further comprising:

a first motion sensor in communication with said pump to operate the first timer; and a second motion sensor in communication with said pump to operate the second timer.

28. A system for flushing a toilet that has a discharge hole in the tank of the toilet, which comprises:

a deflatable resilient container having an interior and being seated within the discharge hole of the toilet so as to seal the discharge hole;

a pump having an inlet and an outlet;

a tube having a first end connected to and in fluid communication with the inlet of said pump and having a second end connected to and in fluid communication with the interior of said deflatable resilient container; and a means for controlling the time the deflatable resilient container is sufficiently deflated not to seal the discharge hole.

29. The system for flushing a toilet that has a discharge hole in the tank of the toilet as recited in claim 28, wherein:

said means for controlling the time the deflatable resilient container is sufficiently deflated not to seal the discharge hole comprises an aperture in said tube.

30. The system for flushing a toilet as recited in claim 28, wherein:

said means for controlling the time the deflatable resilient container is sufficiently deflated not to seal the discharge hole comprises a valve in said tube, said valve being switchable between two differently sized exhaust ports associated with said valve.

31. The system for flushing a toilet as recited in claim 28, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and further comprising:

a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump; and a second tube having a first end attached to and in fluid communication the inlet of said second mechanical pump and a second end attached to and in fluid communication with the outlet of said first mechanical pump.

32. The system for flushing a toilet as recited in claim 28, further comprising:

a second pump having an inlet and an outlet; and a second tube having a first end connected to and in fluid communication with the inlet of said second pump and having a second end connected to and in fluid communication with the interior of said floatable, adjustably buoyant container.

33. The system for flushing a toilet as recited in claim 32, wherein:

said pump is a first mechanical pump having a first check valve in fluid communication with the inlet of said first mechanical pump to permit fluid flow into said first mechanical pump and having a second check valve in fluid communication with the outlet of said first mechanical pump to permit fluid flow from said first mechanical pump; and said second pump is a second mechanical pump having and inlet and an outlet and also having a first check valve in fluid communication with the inlet of said second mechanical pump to permit fluid flow into said second mechanical pump and having a second check valve in fluid communication with the outlet of said second mechanical pump to permit fluid flow from said second mechanical pump.

34. The system for flushing a toilet as recited in claim 32, wherein:

said first pump is an electrical pump; and said second pump is an electrical pump.

35. The system for flushing a toilet as recited in claim 28, wherein:

said pump is an electrical pump having adjustable timing circuitry to reverse the fluid flow through said pump; and further comprising:

a first motion sensor in communication with said pump to select a shorter flush time on the adjustable timing circuitry; and a second motion sensor in communication with said pump to select a longer flush time on the adjustable timing circuitry.

36. The system for flushing a toilet as recited in claim 28, wherein:

said pump is an electrical pump having a first timer with a first flushing time and a second time with a second flushing time; and further comprising:

a first motion sensor in communication with said pump to operate the first timer; and a second motion sensor in communication with said pump to operate the second timer.

* * * * *